US006395044B1

(12) United States Patent
Swei et al.

(10) Patent No.: US 6,395,044 B1
(45) Date of Patent: May 28, 2002

(54) SCENTED ENGINEERED ABRASIVES

(75) Inventors: Gwo Shin Swei, East Amherst, NY (US); Thomas G. Kinisky, Shrewsbury, MA (US); Americo Geza Denes, Sao Paulo (BR)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 09/972,317

(22) Filed: Oct. 5, 2001

(51) Int. Cl.[7] ..... B24D 3/00; B24D 3/34; B24D 11/00

(52) U.S. Cl. ..... 51/298; 51/295; 51/307; 51/309

(58) Field of Search ..... 51/298, 295, 307, 51/308, 309

(56) References Cited

U.S. PATENT DOCUMENTS

| | | | | | |
|---|---|---|---|---|---|
| 5,833,724 | A | * | 11/1998 | Wei | 51/309 |
| 5,863,306 | A | * | 1/1999 | Wei | 51/298 |
| 6,096,107 | A | * | 8/2000 | Caracostas et al. | 51/307 |
| 6,293,980 | B2 | * | 9/2001 | Wei et al. | 51/298 |

* cited by examiner

*Primary Examiner*—Michael Marcheschi
(74) *Attorney, Agent, or Firm*—David Bennett

(57) ABSTRACT

The invention provides coated abrasives with an engineered surface that releases a pleasing fragrance when used.

8 Claims, 1 Drawing Sheet

SCENTED ENGINEERED ABRASIVES

BACKGROUND OF INVENTION

Figure 1:
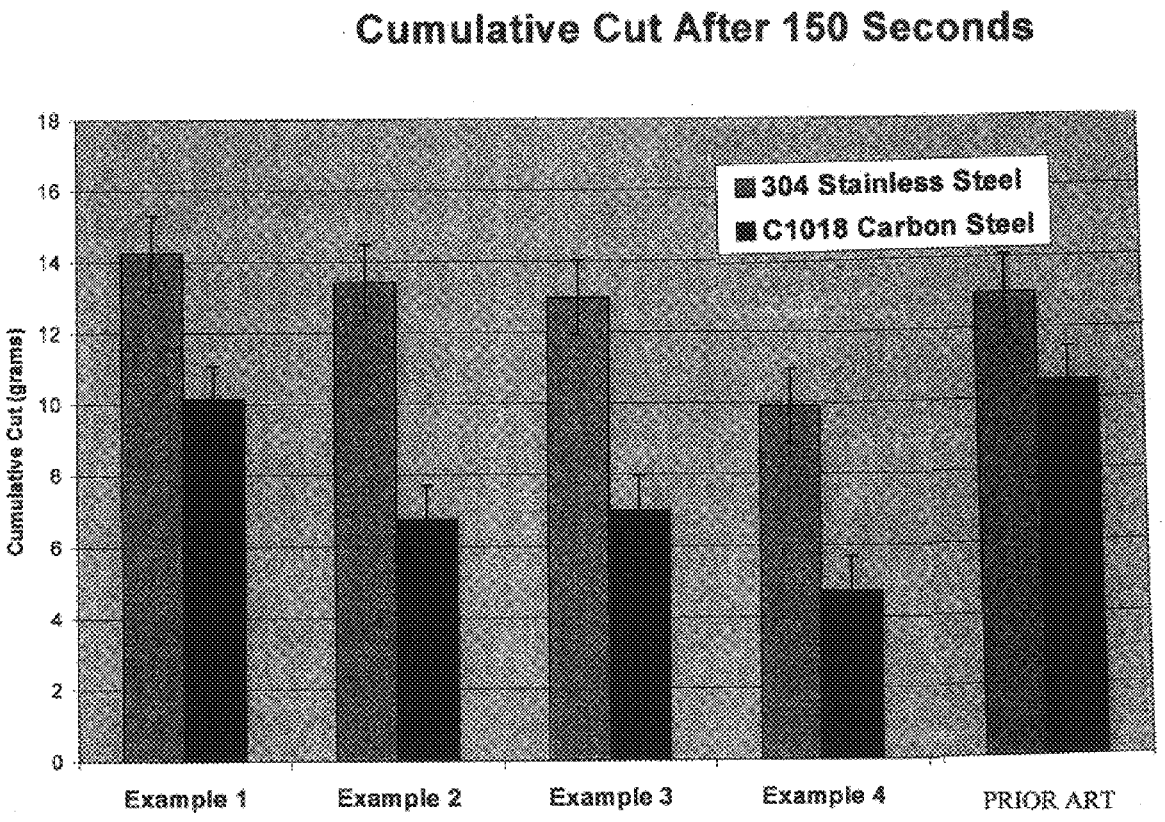

The present invention relates to coated abrasives and specifically to coated abrasives with an abrasive surface that has been engineered to provide a plurality of individual structures comprising a cured binder having dispersed therein abrasive particles. These structures can be made by a molding, embossing or a patterned deposition approach. Each however provides a structure with the advantages of an open coated abrasives with separate abrading points, space for the swarf generated to be removed from the immediate abrading area, and fine finish resulting from the use of relatively fine abrasive particles.

Engineered abrasives are coated abrasives in which the abrasive surface is in the form of repeating shapes comprising abrasive particles dispersed in a cured binder disposed on a backing material. In general the performance of these products depends on the contours of the repeating shapes which frequently have the form of structures that diminish in width with distance from the plane of the backing. The shapes can be in the form of parallel ridges, pyramids with square or triangular bases, or somewhat rounded shapes. Coated abrasives of this type are described for example in U.S. Pat. Nos. 5,014,468; 5,152,917; 5,454,844; 5,489,235; 5,672,097; 5,681,217; 5,833,724; 5,840,088; and 5,863,306. Within these variations it is possible to vary the size, spacing, frequency of repetition and so on of the structures, as well as the materials used to form the structures.

The abrading structures comprising such engineered abrasive surfaces are usually made using binders that are radiation-curable resins and may further comprise additives such as fillers, plasticizers and grinding aids. Many of these can yield unpleasant odors when the engineered abrasive is used to abrade a substrate and heat is generated as a by-product. This is particularly true of "water-proof" products that are intended for use in applications in which water is used either to sweep away swarf or as a coolant.

The object of this invention is to overcome negative reactions to an engineered abrasive product by neutralizing the unpleasant odors and rendering the experience of using the engineered abrasive at the same time a satisfying experience from both the technical and the olfactory viewpoints.

GENERAL DESCRIPTION OF THE INVENTION

The present invention provides an engineered abrasive comprising a backing and, applied thereto, at least one abrasive-containing layer engineered to provide a plurality of individual abrasive composite structures, said engineered abrasive having incorporated therein a composition including an additive with a pleasant fragrance. While it is understood that "pleasing" is often a matter of subjective judgment, in the context of this Application the word is intended to refer to fragrances that are generically regarded as pleasing such as floral, musk or citrus fragrances. However it should also be understood that, as part of a promotional program or to address local cultural prejudices as to what constitutes "pleasant", other fragrances such as those of beer, cigar smoke or new-mown grass might be substituted.

The fragrance can be applied to the backing where this is of an absorbent nature such as a paper or cloth material. More preferably however it is incorporated as a component of an abrasive/binder precursor slurry from which are formed the individual abrasive composite structures that make up the engineered abrasive surface. Alternatively it may be applied as a component of a layer applied to the surface of the abrasive/binder slurry before or after the individual composite structures are formed.

The fragrance can be added as a liquid but this is generally not favored since the liquid tends to be lost during production of the engineered abrasive rather than be liberated during use. It is therefore preferred to add the fragrance absorbed on a porous powder carrier or encapsulated in a membrane that can be ruptured under grinding conditions. The membrane can be glass or plastic or ceramic for example. The material is less important than the ability to rupture when the engineered abrasive is in use and not during the production process.

The amount of the fragrance added should not be more than 5% by weight of any layer to which it is added. Preferably the amount is from 1 to 3% of such weight. The weight referred to includes the weight of any carrier or encapsulation that accompanies the fragrance. This is because the added material usually has minimal contribution to the grinding performance of the product and may indeed negatively impact the performance to the extent that it is displacing abrasive material from the formulation. It is most preferred to incorporate the fragrance absorbed into a porous form of a grinding aid such as potassium fluoroborate or cryolite. For example it is known to add grinding aids in the form of agglomerates of the powdered grinding aid loosely held together by a binder material. Absorbing the fragrance into such an agglomerate provides an agglomerated additive with the dual function of assisting the efficiency of the grinding and at the same time releasing the pleasant fragrance. Equally the carrier could be an agglomerate or other porous form of another useful additive.

DRAWING

FIG. 1 is a bar chart presentation of the data generated in Example 1.

DETAILED DESCRIPTION OF THE INVENTION

The invention is particularly useful when the engineered abrasive surface comprises a coating of a functional powder, separately applied and bonded to the surface or applied to the UV-curable binder/abrasive mixture from which the composites are formed before cure of the binder such that the powder is concentrated in the surface layer of the composites as taught in U.S. Pat. No. 5,833,724. Fragrance added in conjunction with such functional powder is a particularly preferred option.

The term "functional powder" is used to refer to finely divided material that modifies the abrasive qualities of the engineered abrasives to which it is applied. This can be as simple as making the engineered abrasive cut more aggressively or reducing the buildup of swarf or static charge on the surface. Some functional powders can additionally serve as a releasing agent or a barrier between the resin formulation and an embossing tool, reducing sticking problems and allowing improved release. Included under the heading of "functional powders" are fine abrasive grits, grinding aids, anti-static additives, lubricant powders and the like. The individual particles of the powder typically have an average particle size, ($D_{50}$), less than about 250 micrometers such as from 1 to 150 micrometers and more preferably from 10 to 100 micrometers. Powders having absorbed fragrances are generally used in the same size range. It is especially preferred to have the fragrance absorbed onto a functional powder having also another utility such as one of those indicated above.

The fragrance can also be provided as a component of a top size coat which is a layer comprising a cured binder which is deposited over the functional powder and acts to help retain the particles of powder in position during grinding. As the name indicates it is the topmost layer of the coated abrasive and is therefore the layer that first contacts a workpiece when the coated abrasive is in use. The top size coat can also comprise other components besides the fragrance such as more abrasive particles, a filler or a pigment to modify the physical properties and/or appearance of the surface. The binder can be a thermosetting resin or a radiation curable resin. Examples of such resins include phenol/formaldehyde resins; urea/formaldehyde resins; epoxy resins; (meth)acrylate polymers and copolymers; urethane(meth)acrylate resins; polyester/(meth)acrylate resins; epoxy-(meth)acrylate resins and other resins known in the art for such applications.

Such a top size layer is preferably compatible with the layer over which it is applied. This is preferred to ensure that the cured top size layer will not flake off the layer immediately below under grinding conditions. For example composites in which the cured binder is an acrylate-based radiation-cured binder can be over laid by a top layer that is also an acrylate resin, an epoxy resin or a phenolic resin.

The fragrance can also be incorporated in with the binder resin component of the curable binder/abrasive formulation from which the abrasive structures are formed. Examples of such resins include phenol/formaldehyde resins; urea/formaldehyde resins; epoxy resins; (meth)acrylate polymers and copolymers; urethane(meth)acrylate resins; polyester/(meth)acrylate resins; epoxy-(meth)acrylate resins and other resins known in the art for such applications.

The formation of the engineered abrasive surface can be by any of those techniques known in the art in which a slurry composite of abrasive and a binder precursor is cured while in contact with a backing and a production tool so as to be adhered on one surface to the backing and, to have imposed on the other surface the precise shape of the inside surface of the production tool. Such a process is described for example in U.S. Pat. Nos. 5,152,917; 5,304,223; 5,378,251; and 5,437,254 all of which are incorporated herein by reference. Alternative formation methods, including rotogravure coating, are described in U.S. Pat. Nos. 5,014,468 and 4,773,920 and these too are incorporated by reference in this Application.

The invention will be further described with respect to the following Examples which are understood to be for the purposes of illustration only and imply no necessary limitation on the scope of the invention.

EXAMPLES 1 TO 4

In these Examples the performance of products according to the invention in which the fragrance is added in two different ways is evaluated against a standard material of identical construction but made without the fragrance additive.

In the first mode of addition the fragrance additive was incorporated along with the binder and the abrasive grits from which the engineered abrasive surface was created by an embossing technique. In the second mode of addition, the fragrance additive was incorporated into a functional powder added over the surface of the curable binder/abrasive particles formulation prior to embossing to form the engineered surface. In all other respects the structure and formation of the engineered abrasives was identical.

In each case the abrasive was FEPA grade P320 grit alumina and made into an engineered abrasive using the process described and claimed in U.S. Pat. No. 5,863,306. The fragrance was added as a solution of a citrus fragrance in a volatile organic solvent. This was absorbed into an inorganic inert powder to a 50% by weight loading. This powder was then incorporated at levels of 0% and 3% by weight in the abrasive/curable binder slurry from which the abrasive structures were formed by an embossing process. The powder was also included at 1% and 5% by weight levels in a functional powder comprising abrasive grits and a grinding aid applied over the slurry prior to embossing. This resulted in the following matrix of tests:

| | | % Fragrance Powder in Functional Powder | |
|---|---|---|---|
| | | 1% | 5% |
| % Fragrance Powder in Slurry | 0% | Example 1 | Example 2 |
| | 3% | Example 3 | Example 4 |

The engineered abrasive produced was in each case converted into abrasive belts 2 inches (5.08 cm) wide and 132 inches (335.3 cm) in length. These belts were then used on a Bader grinder at a speed of 5200 sfpm (1600 smpm), at an applied pressure of 15 psi, (103410 newtons/$m^2$) to grind 304 stainless steel and C1018 carbon steel workpieces. The cumulative amount of metal cut after 150 seconds of grinding was measured and the results are indicated on the bar graph presented as FIG. 1.

This graph also indicates the performance of the same belt without the addition of the fragrance powder. While the performance is in some cases, (particularly when the additive was incorporated in the slurry), a little lower in terms of actual metal cut, the chart does not record the expressions on the faces of the users which showed a distinct preference for the belts with the citrus fragrance released upon use.

What we claim is:

1. An engineered abrasive comprising a backing and, applied thereto, at least one abrasive-containing layer engineered to provide a plurality of individual structures, said engineered abrasive having incorporated therein an additive comprising a pleasant fragrance.

2. An engineered abrasive according to claim 1 in which the fragrance is incorporated into the abrasive containing layer.

3. An engineered abrasive according to claim 1 in which the fragrance is incorporated into a layer applied over the abrasive containing layer.

4. An engineered abrasive according to claim 1 in which the backing is an absorbent material and the fragrance is absorbed into said backing.

5. An engineered abrasive according to claim 4 in which the fragrance is sprayed on the backing.

6. An engineered abrasive according to claim 1 in which the fragrance is incorporated in a formulation in which the fragrance represents an amount that is from 1 to 5% by weight of the formulation.

7. An engineered abrasive according to claim 1 in which the additive is incorporated in the engineered abrasive in the form of a powder having the fragrance absorbed thereon.

8. An engineered abrasive according to claim 1 in which the fragrance is incorporated in the engineered abrasive in the form of droplets encapsulated by a container that ruptures under grinding conditions.

* * * * *